US010151516B2

(12) United States Patent
Shang et al.

(10) Patent No.: US 10,151,516 B2
(45) Date of Patent: Dec. 11, 2018

(54) HEAT EXCHANGER AND AIR CONDITIONER COMPRISING THE HEAT EXCHANGER

(71) Applicant: GREE ELECTRIC APPLIANCES, INC. OF ZHUHAI, Zhuhai, Guangdong (CN)

(72) Inventors: Bin Shang, Zhuhai (CN); Youjian Zeng, Zhuhai (CN); Minyan Wang, Zhuhai (CN)

(73) Assignee: GREE ELECTRIC APPLIANES, INC. OF ZHUHAI, Zhuhai, Guangdong (CN)

( * ) Notice: Subject to any disclaimer, the term of this patent is extended or adjusted under 35 U.S.C. 154(b) by 0 days.

(21) Appl. No.: 15/505,469

(22) PCT Filed: Jul. 30, 2015

(86) PCT No.: PCT/CN2015/085626
§ 371 (c)(1),
(2) Date: Feb. 21, 2017

(87) PCT Pub. No.: WO2016/026376
PCT Pub. Date: Feb. 25, 2016

(65) Prior Publication Data

US 2017/0276410 A1 Sep. 28, 2017

(30) Foreign Application Priority Data

Aug. 22, 2014 (CN) ..... 2014 1 0419569

(51) Int. Cl.
*F25B 39/00* (2006.01)
*F25B 39/04* (2006.01)
(Continued)

(52) U.S. Cl.
CPC ..... *F25B 39/00* (2013.01); *F25B 39/04* (2013.01); *F28F 1/325* (2013.01); *F28F 9/0246* (2013.01);
(Continued)

(58) Field of Classification Search
CPC ..... F25B 39/00; F25B 2500/01; F28F 1/325; F28F 9/0246; F28F 2210/04; F28F 2220/00
(Continued)

(56) References Cited

U.S. PATENT DOCUMENTS 1,908,463 A * 5/1933 Torrance ..... F25B 39/04 165/110
2,181,354 A * 11/1939 Winters ..... F25B 49/027 165/132
(Continued)

FOREIGN PATENT DOCUMENTS

CN 201593893 U 9/2010
CN 20130017424 A 2/2013
CN 202770076 U 3/2013

OTHER PUBLICATIONS

European Patent Office, European patent search report dated Mar. 7, 2018.

*Primary Examiner* — Justin Jonaitis
(74) *Attorney, Agent, or Firm* — Li & Cai Intellectual Property (USA) Office

(57) ABSTRACT

A heat exchanger and an air conditioner comprising the heat exchanger are provided. The heat exchanger includes a gaseous refrigerant heat exchange pipe (6) and a liquid refrigerant heat exchange pipe (7) provided on the same side of the heat exchanger, the heat exchanger further includes a gaseous refrigerant heat exchange branch pipe (2) and a liquid refrigerant heat exchange branch pipe (3). During installation of the heat exchanger and the air conditioner, a pipe exiting direction may be selected according to user
(Continued)

demands without bending the pipes, a pipe routing space does not need to be reserved on the back of the whole machine, and installation is facilitated.

20 Claims, 2 Drawing Sheets

(51) Int. Cl.
*F28F 1/32* (2006.01)
*F28F 9/02* (2006.01)

(52) U.S. Cl.
CPC ..... *F25B 2500/01* (2013.01); *F28F 2210/04* (2013.01); *F28F 2220/00* (2013.01)

(58) Field of Classification Search
USPC ..... 165/137, 148, 150, 151, 152, 153
See application file for complete search history.

(56) References Cited

U.S. PATENT DOCUMENTS 5,076,353 A * 12/1991 Haussmann ..... F25B 39/04 165/110
5,146,766 A * 9/1992 Martins ..... F16L 39/00 62/298
5,157,944 A * 10/1992 Hughes ..... F25B 39/028 165/139
5,651,265 A * 7/1997 Grenier ..... F24J 3/081 165/45
5,699,675 A * 12/1997 Nagai ..... F25B 9/006 165/150
5,937,669 A * 8/1999 Okuri ..... F25B 6/04 62/114
5,983,998 A * 11/1999 Kim ..... F28D 1/0477 165/122
2004/0182101 A1* 9/2004 Shimoda ..... F25B 13/00 62/324.1
2005/0066684 A1* 3/2005 Matsuoka ..... F04B 39/02 62/470
2005/0257564 A1* 11/2005 Wightman ..... F25B 41/04 62/510
2006/0185825 A1* 8/2006 Chen et al. ..... F28D 15/00 165/104.21
2011/0308270 A1* 12/2011 Maeng ..... B60H 1/00207 62/335

* cited by examiner

HEAT EXCHANGER AND AIR CONDITIONER COMPRISING THE HEAT EXCHANGER

TECHNICAL FIELD OF THE INVENTION

The invention relates to an air conditioner, and more particularly to a heat exchanger and an air conditioner comprising the heat exchanger.

BACKGROUND OF THE INVENTION

During installation of an existing air conditioner, a pipe routing mode of a heat exchanger usually includes a liquid refrigerant heat exchange pipe and a gaseous refrigerant heat exchange pipe, and both the liquid refrigerant heat exchange pipe and the gaseous refrigerant heat exchange pipe are usually installed on the right side of the heat exchanger. However, during installation of the air conditioner, an installation mode adopting leftward pipe routing or rightward pipe routing probably exists according to user demands. An existing air conditioning heat exchanger only adopts a single pipe routing mode, and has the technical problem of inconvenient installation.

SUMMARY OF THE INVENTION

The embodiments of the invention provide a heat exchanger and an air conditioner comprising the heat exchanger. A pipe may be connected to any side as required. The structure is simple, and installation is facilitated.

To solve the above-mentioned technical problem, the embodiments of the invention provide a heat exchanger, which may include: a gaseous refrigerant heat exchange pipe; a liquid refrigerant heat exchange pipe, the liquid refrigerant heat exchange pipe and the gaseous refrigerant heat exchange pipe being provided on the same side of the heat exchanger; a gaseous refrigerant heat exchange branch pipe, communicated with the gaseous refrigerant heat exchange pipe, the gaseous refrigerant heat exchange branch pipe comprising a first gaseous refrigerant heat exchange branch pipe located on the first side of the heat exchanger and a second gaseous refrigerant heat exchange branch pipe located on the side, opposite to the first side, of the heat exchanger; and a liquid refrigerant heat exchange branch pipe, communicated with the liquid refrigerant heat exchange pipe, the liquid refrigerant heat exchange branch pipe comprising a first liquid refrigerant heat exchange branch pipe located on the first side of the heat exchanger and a second liquid refrigerant heat exchange branch pipe located on the side, opposite to the first side, of the heat exchanger. Each of pipe openings of the first gaseous refrigerant heat exchange branch pipe, the second gaseous refrigerant heat exchange branch pipe, the first liquid refrigerant heat exchange branch pipe and the second liquid refrigerant heat exchange branch pipe may be provided with an opening and closing device separately, which is configured to open or close the pipe opening.

Preferably, the heat exchanger may further include a fin, a gaseous refrigerant heat exchange branch pipe channel and a liquid refrigerant heat exchange branch pipe channel may be provided on the fin, the gaseous refrigerant heat exchange branch pipe may run through the gaseous refrigerant heat exchange branch pipe channel, and the liquid refrigerant heat exchange branch pipe may run through the liquid refrigerant heat exchange branch pipe channel.

Preferably, the heat exchanger may further include a gas pipe connecting device, the gaseous refrigerant heat exchange branch pipe being communicated with the gaseous refrigerant heat exchange pipe by means of the gas pipe connecting device.

Preferably, the gas pipe connecting device may be a three-way gas collecting joint.

Preferably, the gaseous refrigerant heat exchange pipe may be provided on the first side of the heat exchanger, and the three-way gas collecting joint may be connected to the first gaseous refrigerant heat exchange branch pipe.

Preferably, the heat exchanger may further include a liquid pipe connecting device, the liquid refrigerant heat exchange branch pipe being communicated with the liquid refrigerant heat exchange pipe by means of the liquid pipe connecting device.

Preferably, the liquid pipe connecting device may be a three-way liquid inlet joint.

Preferably, the liquid refrigerant heat exchange pipe may be provided on the first side of the heat exchanger, and the three-way liquid inlet joint may be connected to the first liquid refrigerant heat exchange branch pipe.

Preferably, the opening and closing device may be a plug.

According to another aspect of the invention, an air conditioner is also provided, which may include the heat exchanger according to any one of the above-mentioned items, the heat exchanger being an evaporator or a condenser.

According to a further aspect of the invention, a heat exchanger is provided, which may include: a gaseous refrigerant heat exchange pipe; a liquid refrigerant heat exchange pipe, the liquid refrigerant heat exchange pipe and the gaseous refrigerant heat exchange pipe being provided on the same side of the heat exchanger; a gaseous refrigerant heat exchange branch pipe, communicated with the gaseous refrigerant heat exchange pipe, the gaseous refrigerant heat exchange branch pipe comprising a first gaseous refrigerant heat exchange branch pipe located on the first side of the heat exchanger and a second gaseous refrigerant heat exchange branch pipe located on the side, opposite to the first side, of the heat exchanger; and a liquid refrigerant heat exchange branch pipe, communicated with the liquid refrigerant heat exchange pipe, the liquid refrigerant heat exchange branch pipe comprising a first liquid refrigerant heat exchange branch pipe located on the first side of the heat exchanger and a second liquid refrigerant heat exchange branch pipe located on the side, opposite to the first side, of the heat exchanger.

Preferably, pipe openings of the first gaseous refrigerant heat exchange branch pipe, the second gaseous refrigerant heat exchange branch pipe, the first liquid refrigerant heat exchange branch pipe and the second liquid refrigerant heat exchange branch pipe may be provided with an opening and closing device separately, the devices being configured to open or close the pipe openings of the first gaseous refrigerant heat exchange branch pipe, the second gaseous refrigerant heat exchange branch pipe, the first liquid refrigerant heat exchange branch pipe and the second liquid refrigerant heat exchange branch pipe.

Preferably, the heat exchanger may further include a fin, a gaseous refrigerant heat exchange branch pipe channel and a liquid refrigerant heat exchange branch pipe channel may be provided on the fin, the gaseous refrigerant heat exchange branch pipe may run through the gaseous refrigerant heat exchange branch pipe channel, and the liquid refrigerant heat exchange branch pipe may run through the liquid refrigerant heat exchange branch pipe channel.

Preferably, the heat exchanger may further include a gas pipe connecting device, the gaseous refrigerant heat exchange branch pipe being communicated with the gaseous refrigerant heat exchange pipe by means of the gas pipe connecting device.

Preferably, the heat exchanger may further include a liquid pipe connecting device, the liquid refrigerant heat exchange branch pipe being communicated with the liquid refrigerant heat exchange pipe by means of the liquid pipe connecting device.

According to another aspect of the invention, an air conditioner is provided, which may include the above-mentioned heat exchanger, the heat exchanger being an evaporator or a condenser.

According to another aspect of the invention, a heat exchanger is provided, which may include: a gaseous refrigerant heat exchange pipe; a liquid refrigerant heat exchange pipe, the liquid refrigerant heat exchange pipe and the gaseous refrigerant heat exchange pipe being provided on the same side of the heat exchanger; a gaseous refrigerant heat exchange branch pipe, communicated with the gaseous refrigerant heat exchange pipe, the gaseous refrigerant heat exchange branch pipe comprising a first gaseous refrigerant heat exchange branch pipe located on the first side of the heat exchanger and a second gaseous refrigerant heat exchange branch pipe located on the side, opposite to the first side, of the heat exchanger, the first gaseous refrigerant heat exchange branch pipe and the second gaseous refrigerant heat exchange branch pipe being communicated with each other; and a liquid refrigerant heat exchange branch pipe, communicated with the liquid refrigerant heat exchange pipe, the liquid refrigerant heat exchange branch pipe comprising a first liquid refrigerant heat exchange branch pipe located on the first side of the heat exchanger and a second liquid refrigerant heat exchange branch pipe located on the side, opposite to the first side, of the heat exchanger, the first liquid refrigerant heat exchange branch pipe and the second liquid refrigerant heat exchange branch pipe being communicated with each other.

According to the heat exchanger provided by the embodiments of the invention, a gaseous refrigerant heat exchange pipe and a liquid refrigerant heat exchange pipe are provided on the same side of the heat exchanger; a gaseous refrigerant heat exchange branch pipe is communicated with the gaseous refrigerant heat exchange pipe, and the gaseous refrigerant heat exchange branch pipe comprises a first gaseous refrigerant heat exchange branch pipe located on the first side of the heat exchanger and a second gaseous refrigerant heat exchange branch pipe located on the side, opposite to the first side, of the heat exchanger; and a liquid refrigerant heat exchange branch pipe is communicated with the liquid refrigerant heat exchange pipe, and the liquid refrigerant heat exchange branch pipe comprises a first liquid refrigerant heat exchange branch pipe located on the first side of the heat exchanger and a second liquid refrigerant heat exchange branch pipe located on the side, opposite to the first side, of the heat exchanger. Each of pipe openings of the first gaseous refrigerant heat exchange branch pipe, the second gaseous refrigerant heat exchange branch pipe, the first liquid refrigerant heat exchange branch pipe and the second liquid refrigerant heat exchange branch pipe is provided with an opening and closing device separately, which is configured to open or close the pipe opening. Since the gaseous refrigerant heat exchange branch pipe and the liquid refrigerant heat exchange branch pipe comprise two branch pipes respectively and the two branch pipes are located on two sides of the heat exchanger, so that, during installation of the air conditioner, a pipe exiting direction may be selected as required, and the branch pipe on the first side or second side of the heat exchanger is directly connected without bending the gaseous refrigerant heat exchange branch pipe and the liquid refrigerant heat exchange branch pipe, pipe routing for a long distance and reservation of a pipe routing space do not need to be performed on the back of the whole machine, and installation and disassembly are facilitated. Moreover, the whole machine may be manufactured to be thinner and smaller.

BRIEF DESCRIPTION OF THE DRAWINGS

The description drawings forming a part of the application are intended to provide further understanding of the invention. The schematic embodiments and illustrations of the invention are intended to explain the invention, and do not form improper limits to the invention. In the drawings.

DRAWING MARK DESCRIPTIONS

1, fin; 2, gaseous refrigerant heat exchange branch pipe; 3, liquid refrigerant heat exchange branch pipe; 4, gaseous refrigerant heat exchange branch pipe channel; 5, liquid refrigerant heat exchange branch pipe channel; 6, gaseous refrigerant heat exchange pipe; 7, liquid refrigerant heat exchange pipe; 21, first gaseous refrigerant heat exchange branch pipe; 22, second gaseous refrigerant heat exchange branch pipe; 23, three-way gas collecting joint; 24, first gaseous refrigerant heat exchange branch pipe plug; 25, second gaseous refrigerant heat exchange branch pipe plug; 31, first liquid refrigerant heat exchange branch pipe; 32, second liquid refrigerant heat exchange branch pipe; 33, three-way liquid inlet joint; 34, first liquid refrigerant heat exchange branch pipe plug; and 35, second liquid refrigerant heat exchange branch pipe plug.

DETAILED DESCRIPTION OF THE EMBODIMENTS

It is important to note that the embodiments in the application and the characteristics in the embodiments may be combined under the condition of no conflicts. The invention will be described below with reference to the drawings and in combination with the embodiments in detail.

Figure 1:
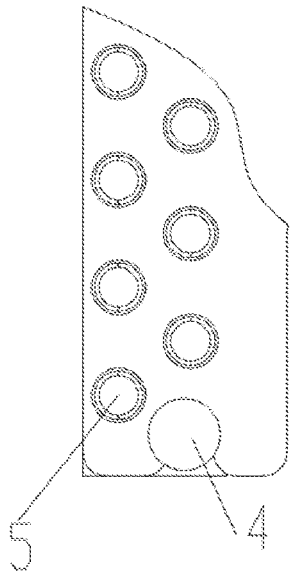
FIG. 1 is a structural diagram of a fin of a heat exchanger according to an embodiment of the invention.
Figure 2:
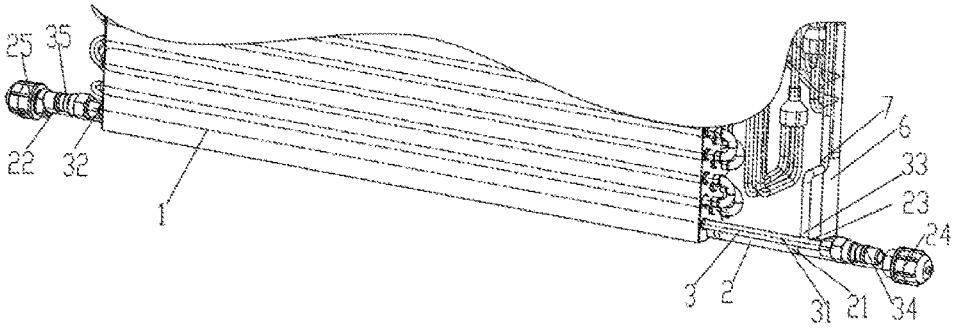
FIG. 2 is a structural diagram of a heat exchanger according to an embodiment of the invention.
Figure 3:
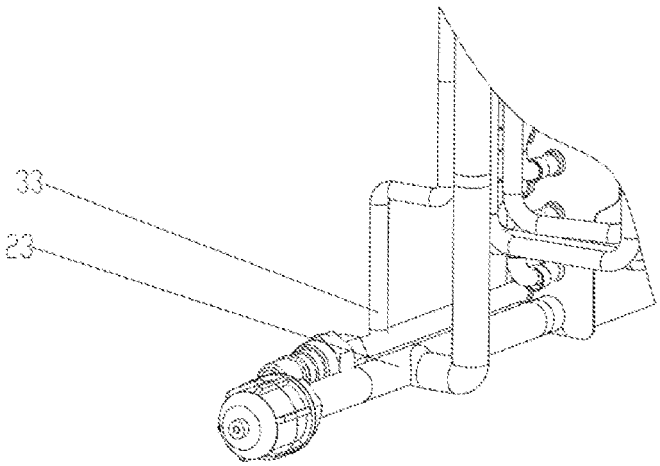
FIG. 3 is a connecting structure diagram of a three-way gas collecting joint and a three-way liquid inlet joint of a heat exchanger according to an embodiment of the invention.

Referring to FIG. 1 to FIG. 3, a heat exchanger according to an embodiment of the invention comprises a fin 1, a gaseous refrigerant heat exchange pipe 6, a liquid refrigerant heat exchange pipe 7, a gaseous refrigerant heat exchange branch pipe 2 and a liquid refrigerant heat exchange branch pipe 3. The gaseous refrigerant heat exchange pipe 6 and the liquid refrigerant heat exchange pipe 7 are provided on the same side of the heat exchanger. The gaseous refrigerant heat exchange branch pipe 2 is communicated with the gaseous refrigerant heat exchange pipe 6, the gaseous refrigerant heat exchange branch pipe 2 comprising a first gaseous refrigerant heat exchange branch pipe 21 located on the first side of the heat exchanger and a second gaseous refrigerant heat exchange branch pipe 22 located on the side, opposite to the first side, of the heat exchange. The liquid refrigerant heat exchange branch pipe 3 is communicated with the liquid refrigerant heat exchange pipe 7, the liquid refrigerant heat exchange branch pipe 3 comprising a first liquid refrigerant heat exchange branch pipe 31 located on the first side of the heat exchanger and a second liquid refrigerant heat exchange branch pipe 32 located on the side, opposite to the first side, of the heat exchanger. Each of pipe openings of the first gaseous refrigerant heat exchange branch pipe 21, the second gaseous refrigerant heat exchange branch pipe 22, the first liquid refrigerant heat exchange branch pipe 31 and the second liquid refrigerant heat exchange branch pipe 32 is provided with an opening and closing device separately, which is configured to open or close the pipe opening. In the embodiments of the invention, the right side of the heat exchanger serves as the first side, the gaseous refrigerant heat exchange pipe 6 and the liquid refrigerant heat exchange pipe 7 are provided on the right side of the heat exchanger, and the first gaseous refrigerant heat exchange branch pipe 21 and the first liquid refrigerant heat exchange branch pipe 31 are located on the right side of the heat exchanger. Since the gaseous refrigerant heat exchange branch pipe 2 and the liquid refrigerant heat exchange branch pipe 3 comprise two branch pipes respectively and the two branch pipes are located on two sides of the heat exchanger, during installation of an air conditioner, a pipe exiting direction may be selected randomly without bending the pipes and without routing a long pipe on the back of the whole machine.

Preferably, a gaseous refrigerant heat exchange branch pipe channel 4 and a liquid refrigerant heat exchange branch pipe channel 5 are provided on the fin 1 of the heat exchanger according to the embodiment of the invention, the gaseous refrigerant heat exchange branch pipe 2 runs through the gaseous refrigerant heat exchange branch pipe channel 4, and the liquid refrigerant heat exchange branch pipe 3 runs through the liquid refrigerant heat exchange branch pipe channel 5.

Preferably, a gas pipe connecting device is provided on the gaseous refrigerant heat exchange branch pipe 2, the gas pipe connecting device in the embodiments of the invention is a three-way gas collecting joint 23, the first gaseous refrigerant heat exchange branch pipe 21 and the gaseous refrigerant heat exchange pipe 6 are located on the first side of the heat exchanger, and the three-way gas collecting joint 23 is connected to the first gaseous refrigerant heat exchange branch pipe 21 and the gaseous refrigerant heat exchange pipe 6 through threads. By means of the gas pipe connecting device, during installation of the air conditioner, no matter whether a user chooses to perform pipe exiting from the first side or second side of the heat exchanger, the gaseous refrigerant heat exchange branch pipe 2 may be communicated with the gaseous refrigerant heat exchange pipe 6 by means of the gas pipe connecting device. The three-way gas collecting joint 23 and the threaded connection mode are adopted, and the gas pipe connecting device is connected to the gaseous refrigerant heat exchange pipe 6 and the first gaseous refrigerant heat exchange branch pipe 21, which are located on the same side, installation and disassembly may be facilitated. Certainly, the above-mentioned aim may be achieved by means of other connecting devices and connecting modes.

Preferably, a liquid pipe connecting device is provided on the liquid refrigerant heat exchange branch pipe 3, the liquid pipe connecting device in the embodiments of the invention is a three-way liquid inlet joint 33, the first liquid refrigerant heat exchange branch pipe 31 and the liquid refrigerant heat exchange pipe 7 are located on the right side of the heat exchanger, and the three-way liquid inlet joint 33 is connected to the first liquid refrigerant heat exchange branch pipe 31 and the liquid refrigerant heat exchange pipe 7 through threads. By means of the liquid pipe connecting device, during installation of an air conditioner, no matter whether the user chooses to perform pipe exiting from the first side or second side of the heat exchanger, the liquid refrigerant heat exchange branch pipe 3 may be communicated with the liquid refrigerant heat exchange pipe 7 by means of the liquid pipe connecting device. The three-way liquid inlet joint 33 and the threaded connection mode are adopted, and the liquid pipe connecting device is connected to the liquid refrigerant heat exchange pipe 7 and the first liquid refrigerant heat exchange branch pipe 31, which are located on the same side, installation and disassembly may be facilitated. Certainly, the above-mentioned aim may be achieved by means of other connecting devices and connecting modes.

In the embodiments of the invention, the opening and closing device provided at the pipe opening of each branch pipe is a plug, which comprises a first gaseous refrigerant heat exchange branch pipe plug 24 provided at the pipe opening of the first gaseous refrigerant heat exchange branch pipe 21, a second gaseous refrigerant heat exchange branch pipe plug 25 provided at the pipe opening of the second gaseous refrigerant heat exchange branch pipe 22, a first liquid refrigerant heat exchange branch pipe plug 34 provided at the pipe opening of the first liquid refrigerant heat exchange branch pipe 31, and a second liquid refrigerant heat exchange branch pipe plug 35 provided at the pipe opening of the second liquid refrigerant heat exchange branch pipe 32. During installation of the air conditioner, when the user chooses to perform pipe existing from the first side, the first gaseous refrigerant heat exchange branch pipe plug 24 and the first liquid refrigerant heat exchange branch pipe plug 34 may be disassembled to be connected to a user pipe, and the second gaseous refrigerant heat exchange branch pipe plug 25 and the second liquid refrigerant heat exchange branch pipe plug 35 are configured to close the second gaseous refrigerant heat exchange branch pipe 22 and the second liquid refrigerant heat exchange branch pipe 32. Similarly, when the user chooses to perform pipe existing from the second side, the second gaseous refrigerant heat exchange branch pipe plug 25 and the second liquid refrigerant heat exchange branch pipe plug 35 may be disassembled, and the first gaseous refrigerant heat exchange branch pipe plug 24 and the first liquid refrigerant heat exchange branch pipe plug 34 are configured to close the first gaseous refrigerant heat exchange branch pipe 21 and the first liquid refrigerant heat exchange branch pipe 31. Certainly, the opening and closing device of the invention may be a nut or other devices, or the aim of the invention may be achieved.

According to another aspect of the invention, an air conditioner is provided, which comprises the above-mentioned heat exchanger, wherein the heat exchanger may be an evaporator or a condenser.

By means of the heat exchanger and the air conditioner in the invention, since the gaseous refrigerant heat exchange branch pipe 2 and the liquid refrigerant heat exchange branch pipe 3 comprise two branch pipes respectively and the two branch pipes are located on two sides of the heat exchanger, during after-sales installation, an appropriate pipe exiting direction is selected according to an actual user indoor structure, a pipe on the left side or right side of the air conditioner is directly connected, and a pipe opening of the pipe does not need to be connected to the other side, so the pipe may be sealed by a plug or a nut. During installation, the pipe does not need to be bended off, and a pipe routing space does not need to be reserved on the back of the whole machine, and the structure is convenient, simple and reliable. Moreover, during design of the air conditioner, a large pipe routing space does not need to be reserved, and the whole machine of the air conditioner may be designed to be thinner and smaller.

When an inner machine needs to be replaced or a pipe routing direction is replaced, a traditional pipe routing mode refers to that: since a joint is probably hidden in the back of the inner machine, the inner machine needs to be disassembled from a wall and then a connecting nut is disassembled. When the pipe routing direction is replaced, the pipe needs to be folded for 180 degrees. These modes are likely to damage the pipe, thereby causing leakage of a coolant, and influencing normal use of the air conditioner. By means of the heat exchanger and the air conditioner provided by the embodiments of the invention, when the inner machine or the pipe routing direction is replaced, a threaded connection between the air conditioner and the pipe is directly removed, so the inner machine may be removed, and then the inner machine or the pipe existing direction of the pipe may be replaced. The simple and convenient effect is achieved. In the whole disassembly process, parts of the pipe are not stressed, thereby preventing from being damaged.

The above is only the preferred embodiments of the invention, and not intended to limit the invention. There may be various modifications and variations in the invention for those skilled in the art. Any modifications, equivalent replacements, improvements and the like made within the spirit and principle of the invention shall fall within the scope of protection of the invention.

The invention claimed is:

1. A heat exchanger, wherein, comprising:

a gaseous refrigerant heat exchange pipe (6);

a liquid refrigerant heat exchange pipe (7), the liquid refrigerant heat exchange pipe (7) and the gaseous refrigerant heat exchange pipe (6) being provided on a same side of the heat exchanger;

a gaseous refrigerant heat exchange branch pipe (2), communicated with the gaseous refrigerant heat exchange pipe (6), the gaseous refrigerant heat exchange branch pipe (2) comprising a first gaseous refrigerant heat exchange branch pipe (21) located on a first side of the heat exchanger and a second gaseous refrigerant heat exchange branch pipe (22) located on a second side, opposite to the first side, of the heat exchanger; and a liquid refrigerant heat exchange branch pipe (3), communicated with the liquid refrigerant heat exchange pipe (7), the liquid refrigerant heat exchange branch pipe (3) comprising a first liquid refrigerant heat exchange branch pipe (31) located on the first side of the heat exchanger and a second liquid refrigerant heat exchange branch pipe (32) located on the second side, opposite to the first side, of the heat exchanger;

each of pipe openings of the first gaseous refrigerant heat exchange branch pipe (21), the second gaseous refrigerant heat exchange branch pipe (22), the first liquid refrigerant heat exchange branch pipe (31) and the second liquid refrigerant heat exchange branch pipe (32) is provided with an opening and closing device separately, which is configured to open or close the pipe opening, the first gaseous refrigerant heat exchange branch pipe (21) and the second gaseous refrigerant heat exchange branch pipe (22) are communicated with the heat exchanger through the gaseous refrigerant heat exchange pipe (6), the first liquid refrigerant heat exchange branch pipe (31) and the second liquid refrigerant heat exchange branch pipe (32) are communicated with the heat exchanger through the liquid refrigerant heat exchange pipe (7).

2. The heat exchanger according to claim 1, wherein the heat exchanger further comprising a fin (1), a gaseous refrigerant heat exchange branch pipe channel (4) and a liquid refrigerant heat exchange branch pipe channel (5) are provided on the fin (1), the gaseous refrigerant heat exchange branch pipe (2) runs through the gaseous refrigerant heat exchange branch pipe channel (4), and the liquid refrigerant heat exchange branch pipe (3) runs through the liquid refrigerant heat exchange branch pipe channel (5).

3. The heat exchanger according to claim 2, wherein heat exchanger further comprising a gas pipe connecting device, the gaseous refrigerant heat exchange branch pipe (2) is communicated with the gaseous refrigerant heat exchange pipe (6) by means of the gas pipe connecting device.

4. The heat exchanger according to claim 3, wherein the gas pipe connecting device is a three-way gas collecting joint (23).

5. The heat exchanger according to claim 4, wherein the gaseous refrigerant heat exchange pipe (6) is provided on the first side of the heat exchanger, and the three-way gas collecting joint (23) is connected to the first gaseous refrigerant heat exchange branch pipe (21).

6. The heat exchanger according to claim 2, wherein heat exchanger further comprising a liquid pipe connecting device, the liquid refrigerant heat exchange branch pipe (3) is communicated with the liquid refrigerant heat exchange pipe (7) by means of the liquid pipe connecting device.

7. The heat exchanger according to claim 6, wherein the liquid pipe connecting device is a three-way liquid inlet joint (33).

8. The heat exchanger according to claim 7, wherein the liquid refrigerant heat exchange pipe (7) is provided on the first side of the heat exchanger, and the three-way liquid inlet joint (33) is connected to the first liquid refrigerant heat exchange branch pipe (31).

9. The heat exchanger according to claim 1, wherein the opening and closing device is a plug.

10. The heat exchanger according to claim 2, wherein the opening and closing device is a plug.

11. The heat exchanger according to claim 3, wherein the opening and closing device is a plug.

12. The heat exchanger according to claim 4, wherein the opening and closing device is a plug.

13. An air conditioner, wherein, comprising the heat exchanger according to any one of claims 1 to 9, the heat exchanger is an evaporator or a condenser.

14. A heat exchanger comprising:

a gaseous refrigerant heat exchange pipe (6);

a liquid refrigerant heat exchange pipe (7), the liquid refrigerant heat exchange pipe (7) and the gaseous refrigerant heat exchange pipe (6) being provided on a same side of the heat exchanger;

a gaseous refrigerant heat exchange branch pipe (2), communicated with the gaseous refrigerant heat exchange pipe (6), the gaseous refrigerant heat exchange branch pipe (2) comprising a first gaseous refrigerant heat exchange branch pipe (21) located on a first side of the heat exchanger and a second gaseous refrigerant heat exchange branch pipe (22) located on a second side, opposite to the first side, of the heat exchanger; and a liquid refrigerant heat exchange branch pipe (3), communicated with the liquid refrigerant heat exchange pipe (7), the liquid refrigerant heat exchange branch pipe (3) comprising a first liquid refrigerant heat exchange branch pipe (31) located on the first side of the heat exchanger and a second liquid refrigerant heat exchange branch pipe (32) located on the second side, opposite to the first side, of the heat exchanger, the first gaseous refrigerant heat exchange branch pipe (21) and the second gaseous refrigerant heat exchange branch pipe (22) are communicated with the heat exchanger through the gaseous refrigerant heat exchange pipe (6), the first liquid refrigerant heat exchange branch pipe (31) and the second liquid refrigerant heat exchange branch pipe (32) are communicated with the heat exchanger through the liquid refrigerant heat exchange pipe (7).

15. The heat exchanger according to claim 14, wherein pipe openings of the first gaseous refrigerant heat exchange branch pipe (21), the second gaseous refrigerant heat exchange branch pipe (22), the first liquid refrigerant heat exchange branch pipe (31) and the second liquid refrigerant heat exchange branch pipe (32) are provided with an opening and closing device separately, the devices being configured to open or close the pipe openings of the first gaseous refrigerant heat exchange branch pipe (21), the second gaseous refrigerant heat exchange branch pipe (22), the first liquid refrigerant heat exchange branch pipe (31) and the second liquid refrigerant heat exchange branch pipe (32).

16. The heat exchanger according to claim 14, wherein the heat exchanger further comprising a fin (1), a gaseous refrigerant heat exchange branch pipe channel (4) and a liquid refrigerant heat exchange branch pipe channel (5) are provided on the fin (1), the gaseous refrigerant heat exchange branch pipe (2) runs through the gaseous refrigerant heat exchange branch pipe channel (4), and the liquid refrigerant heat exchange branch pipe (3) runs through the liquid refrigerant heat exchange branch pipe channel (5).

17. The heat exchanger according to claim 14, wherein the heat exchanger further comprising a gas pipe connecting device, the gaseous refrigerant heat exchange branch pipe (2) is communicated with the gaseous refrigerant heat exchange pipe (6) by means of the gas pipe connecting device.

18. The heat exchanger according to claim 14, wherein the heat exchanger further comprising a liquid pipe connecting device, the liquid refrigerant heat exchange branch pipe (3) is communicated with the liquid refrigerant heat exchange pipe (7) by means of the liquid pipe connecting device.

19. An air conditioner, comprising the heat exchanger according to 14, wherein the heat exchanger is an evaporator or a condenser.

20. A heat exchanger, wherein, comprising:

a gaseous refrigerant heat exchange pipe (6);

a liquid refrigerant heat exchange pipe (7), the liquid refrigerant heat exchange pipe (7) and the gaseous refrigerant heat exchange pipe (6) being provided on same side of the heat exchanger;

a gaseous refrigerant heat exchange branch pipe (2), communicated with the gaseous refrigerant heat exchange pipe (6), the gaseous refrigerant heat exchange branch pipe (2) comprising a first gaseous refrigerant heat exchange branch pipe (21) located on a first side of the heat exchanger and a second gaseous refrigerant heat exchange branch pipe (22) located on a second side, opposite to the first side, of the heat exchanger, the first gaseous refrigerant heat exchange branch pipe (21) and the second gaseous refrigerant heat exchange branch pipe (22) being communicated with each other; and a liquid refrigerant heat exchange branch pipe (3), communicated with the liquid refrigerant heat exchange pipe (7), the liquid refrigerant heat exchange branch pipe (3) comprising a first liquid refrigerant heat exchange branch pipe (31) located on the first side of the heat exchanger and a second liquid refrigerant heat exchange branch pipe (32) located on second the side, opposite to the first side, of the heat exchanger, the first liquid refrigerant heat exchange branch pipe (31) and the second liquid refrigerant heat exchange branch pipe (32) being communicated with each other, the first gaseous refrigerant heat exchange branch pipe (21) and the second gaseous refrigerant heat exchange branch pipe (22) are communicated with the heat exchanger through the a gaseous refrigerant heat exchange pipe (6), the first liquid refrigerant heat exchange branch pipe (31) and the second liquid refrigerant heat exchange branch pipe (32) are communicated with the heat exchanger through the liquid refrigerant heat exchange pipe (7).

* * * * *